US005235500A

United States Patent [19]

Sapper

[11] Patent Number: 5,235,500

[45] Date of Patent: Aug. 10, 1993

[54] LAMP, PARTICULARLY A TABLE LAMP

[75] Inventor: Richard Sapper, Milan, Italy

[73] Assignee: Artemide S.p.A., Milan, Italy

[21] Appl. No.: 756,466

[22] Filed: Sep. 9, 1991

[30] Foreign Application Priority Data

Sep. 11, 1990 [IT] Italy ..... 53229/90[U]

[51] Int. Cl.[5] ..... F21S 1/00

[52] U.S. Cl. ..... 362/426; 362/275; 362/287; 362/419; 362/427

[58] Field of Search ..... 362/275, 287, 371, 413, 362/414, 419, 426, 427

[56] References Cited

U.S. PATENT DOCUMENTS

| | | | |
|---|---|---|---|
| 2,280,402 | 4/1942 | Greppin | 362/419 X |
| 3,790,773 | 2/1974 | Sapper | 362/426 X |
| 4,494,177 | 1/1985 | Matthews | 362/419 X |
| 4,772,993 | 9/1988 | Engel | 362/419 |

FOREIGN PATENT DOCUMENTS

| | | |
|---|---|---|
| 0156290 | 3/1985 | European Pat. Off. . |
| 0351792 | 7/1989 | European Pat. Off. . |
| 3611311 | 4/1986 | Fed. Rep. of Germany . |

*Primary Examiner*—Stephen F. Husar

*Attorney, Agent, or Firm*—Kane, Dalsimer, Sullivan, Kurucz, Levy, Eisele and Richard

[57] ABSTRACT

A lamp comprising a light supported on a structure defining a path for the current supplying the bulb. The light comprises a housing and a support located between the structure and housing. The support consists of two arms hinged at the ends to the structure for enabling the housing to rotate about a first axis; and a pin perpendicular to the arms and supported in rotary manner inside the housing for enabling the housing to rotate in relation to the structure about a second axis perpendicular to the first. The support consists of two electrically insulated parts made of electrically conductive material.

8 Claims, 6 Drawing Sheets

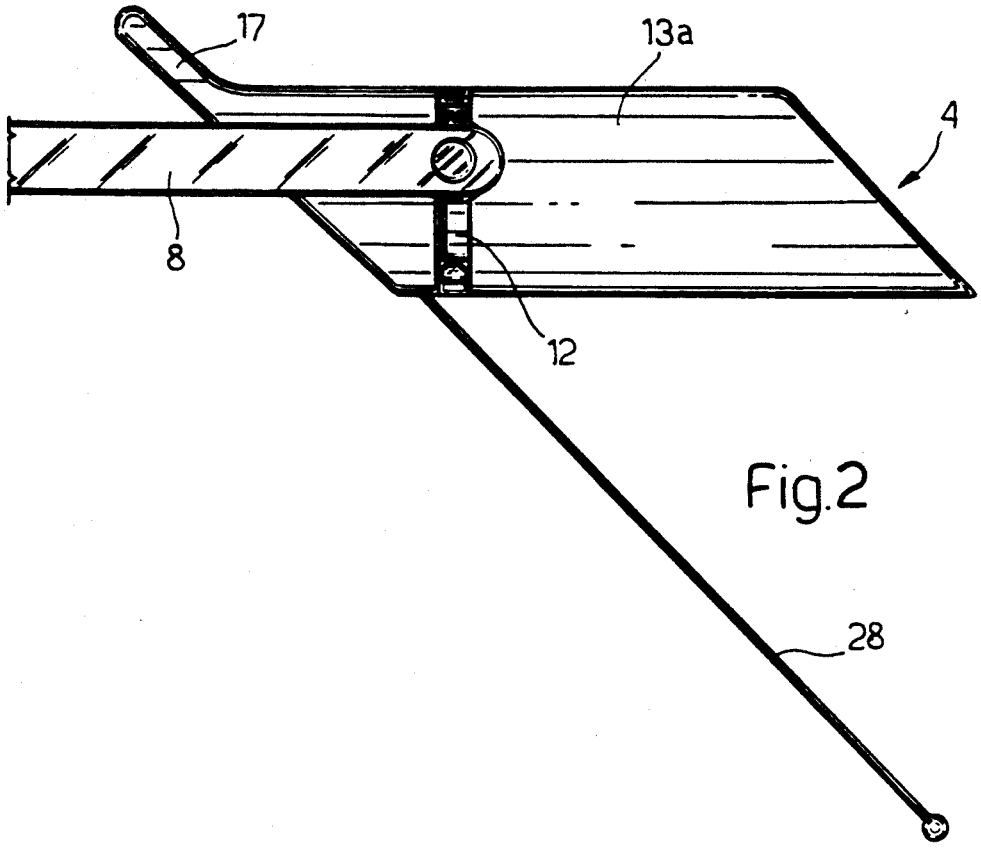
Fig.2
Fig.3
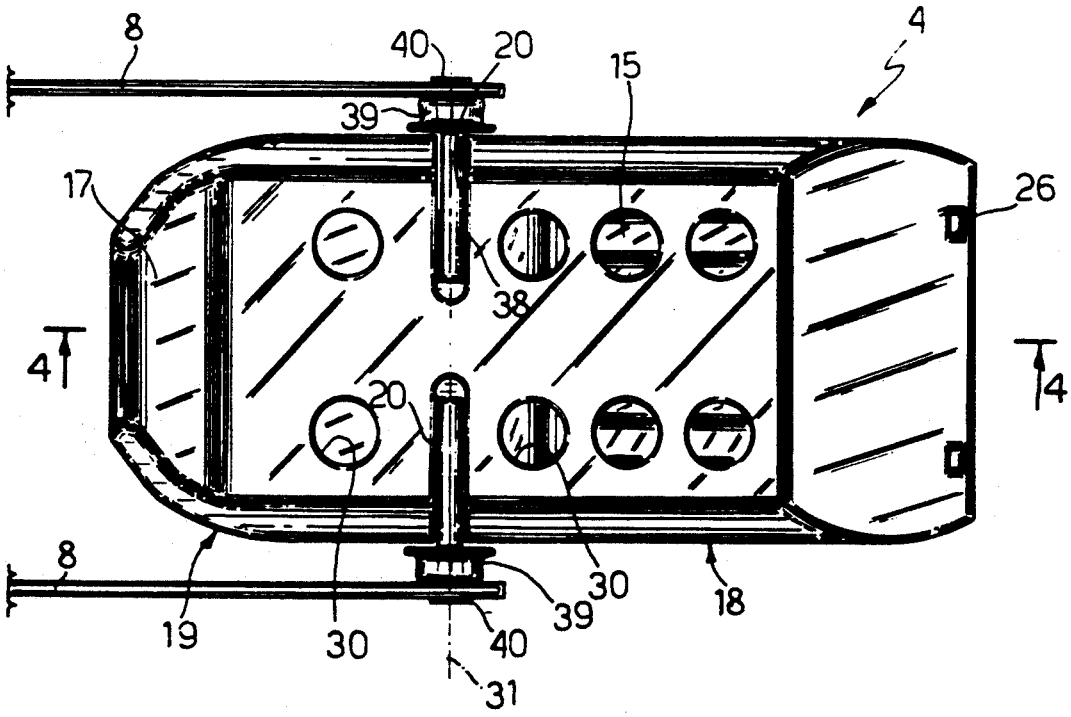

LAMP, PARTICULARLY A TABLE LAMP

BACKGROUND OF THE INVENTION

The present invention relates to a lamp, particularly a table lamp.

In particular, the present invention relates to an improvement to the "Tizio" lamp (registered trade mark) manufactured by the present applicant.

The "Tizio" lamp is known to comprise a base housing a transformer, an articulated extendible arm structure, and a light supported on the articulated structure. The articulated structure in turn consists of three pairs of rods, of which a first pair is fitted to the base, a second pair pivots on the first, about a third of the way along its length, and a third pair pivots on the second, also about a third of the way along its length. The ends of the third pair of rods furthest from the point at which it pivots on the second pair define hinges for the light, to enable this to be raised, lowered and rotated about an axis which, in use, is substantially horizontal.

On the above lamp, the current for the light is supplied along the lamp structure, for eliminating unsightly wiring or wire concealing means.

In view of the success of the above lamp, it has been decided to improve it even further for rendering it even more adaptable to the environment by enabling the beam to be directed as required.

SUMMARY OF THE INVENTION

It is an object of the present invention to provide a lamp, particularly a table lamp of the aforementioned type, enabling troublefree direction of the light beam as required.

According to the present invention, there is provided a lamp, particularly a table lamp, comprising: a base; a load-bearing structure fitted to said base and defining a path along which power is conducted; and a light supported on said structure, said light including a housing and a support located between said structure and said housing and designed to enable rotation of said housing about a first axis, and to ensure electrical continuity between said structure and a bulb fitted to said support; characterised by the fact that said support comprises means enabling rotation of said housing about a second axis perpendicular to the first.

BRIEF DESCRIPTION OF THE DRAWINGS

A preferred non-limiting embodiment of the present invention will be described by way of example with reference to the accompanying drawings, in which:

FIG. 2 shows a larger-scale side view of the light portion of the FIG. 1 lamp;

FIG. 3 shows a top plan view of the FIG. 2 light;

DETAILED DESCRIPTION OF THE INVENTION

Figure 1:
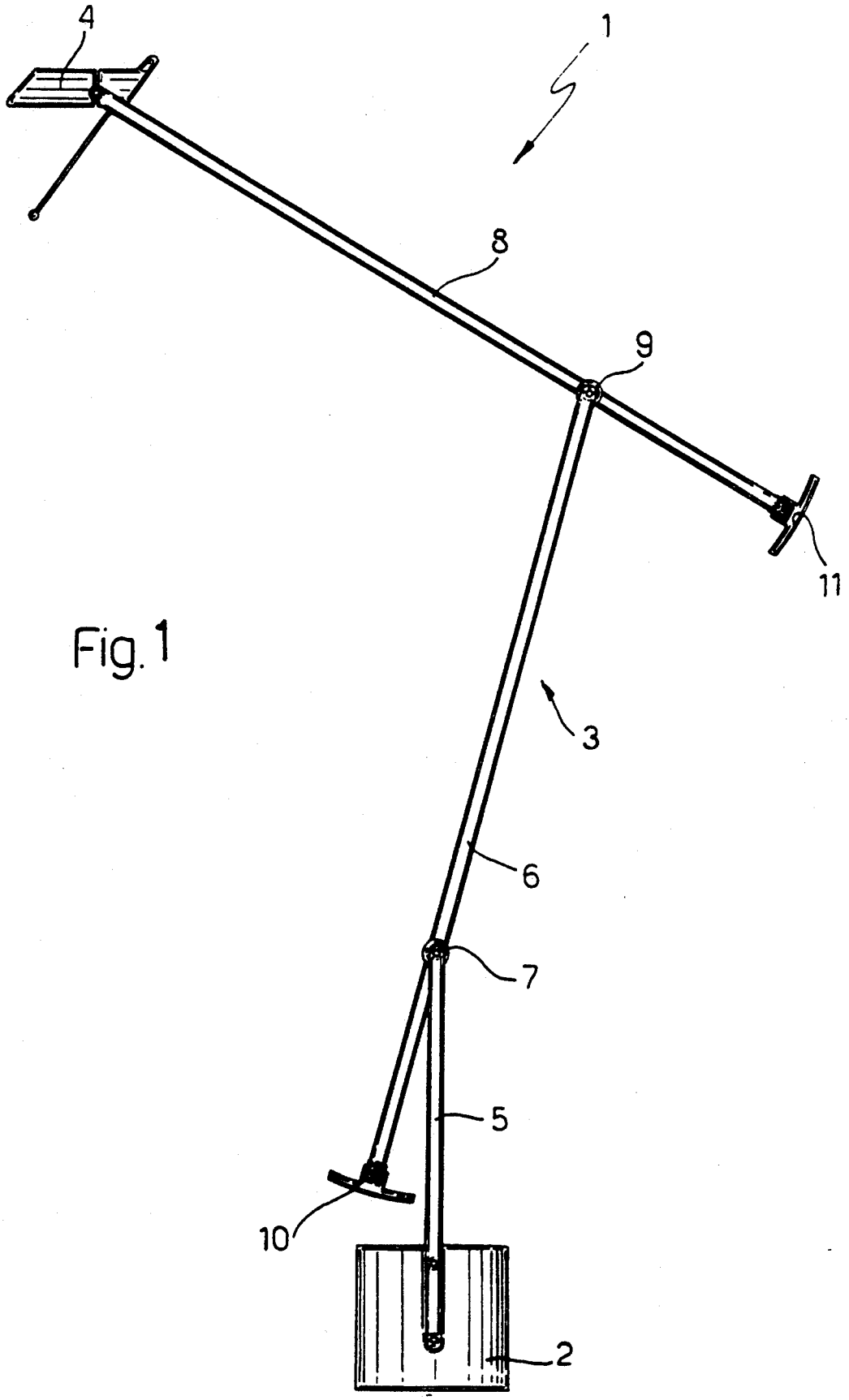
FIG. 1 shows an overall side view of the lamp according to the present invention.

As shown in FIG. 1, the lamp according to the present invention and indicated as a whole by 1 comprises a base 2 (housing a transformer and electronic voltage and brightness adjuster); a load-bearing structure 3; and a light 4. In more detail, said structure 3 comprises three pairs of articulated rods (in FIG. 1, only one rod in each pair is shown): a first pair of rods 5 extending vertically and fitted to either side of base 2; a second pair of rods 6 pivoting on said first pair of rods 5 at point 7 roughly a third of the way along its length; and a third pair of rods 8 pivoting on said second pair of rods 6 at point 9 roughly a third of the way along its length. The free ends of rods 6 and 8 closest to hinge points 7 and 9 are provided with counterweights 10 and 11. Between light 4 and the ends of rods 8 opposite those fitted with counterweights 11, means are provided for rotating light 4 about two perpendicular axes, as described in detail with reference to FIGS. 2-11. Structure 3 is employed in known manner for supplying current to the bulb by defining a conductive path between base 2 and light 4.

Figure 4:
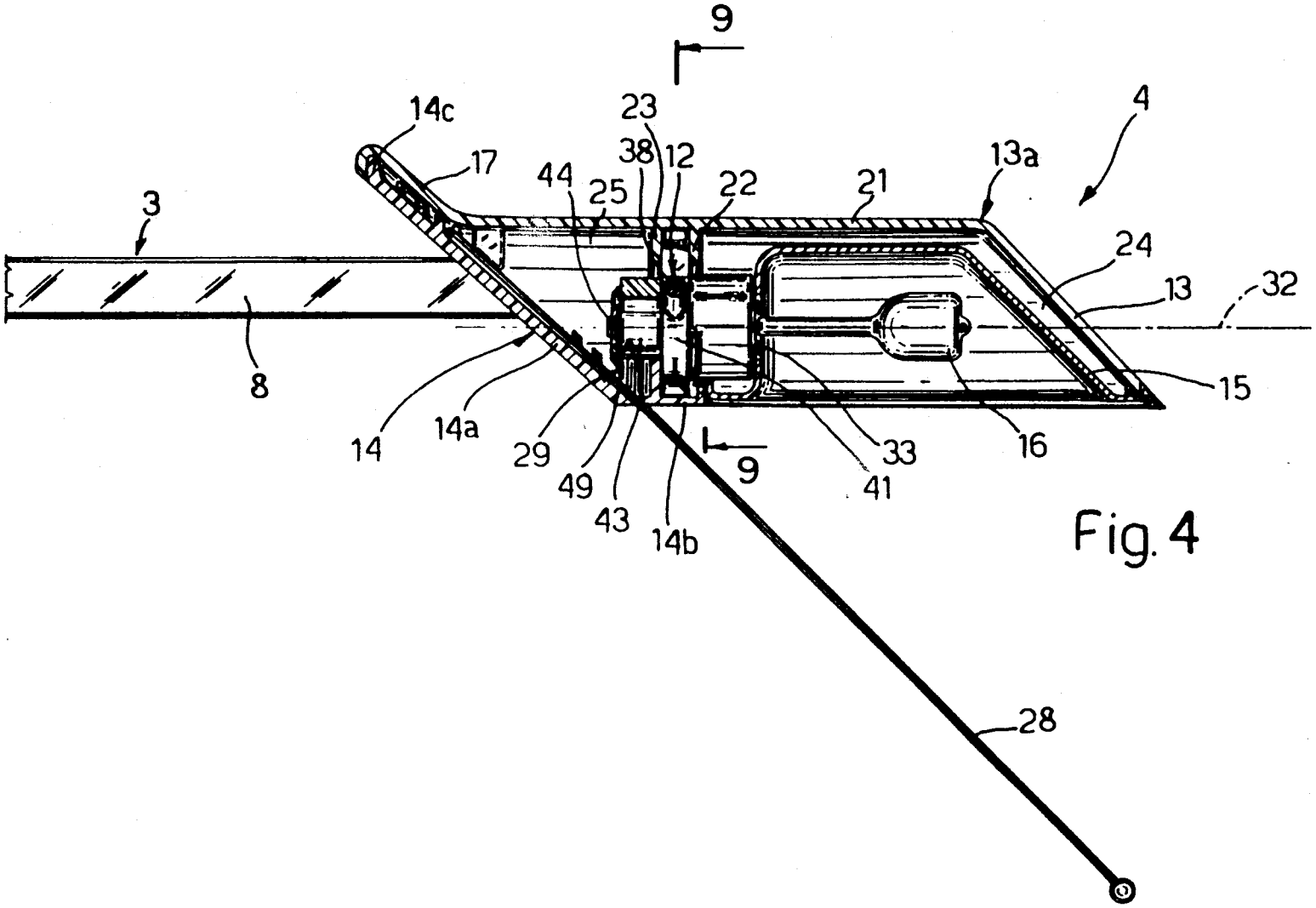
FIG. 4 shows a longitudinal section of the light along line IV—IV in FIG. 3.
Figure 5A:
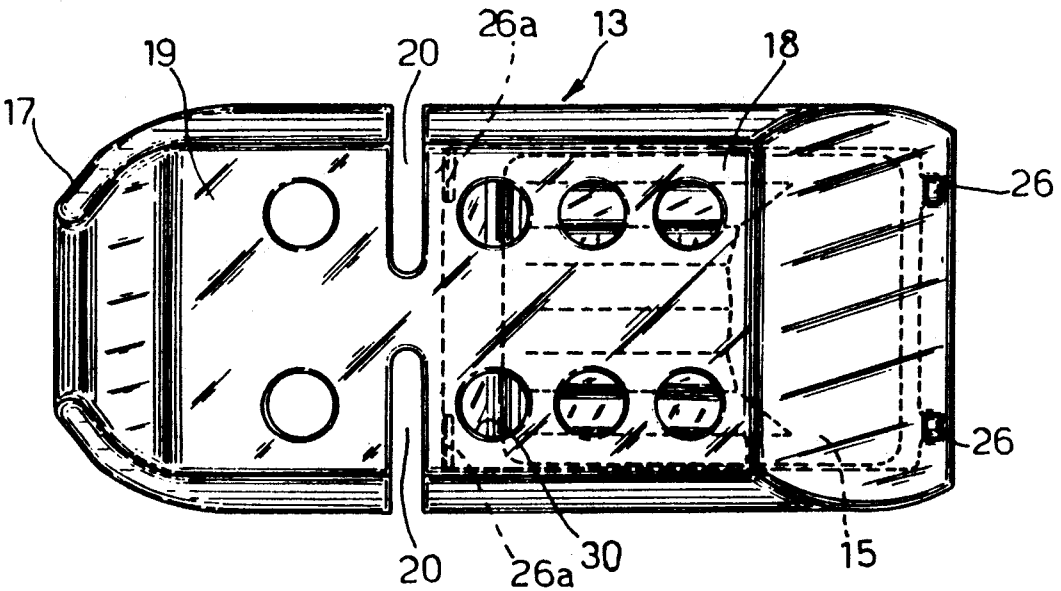
FIGS. 5 and 5A show an exploded top plan view of the light.
Figure 5:
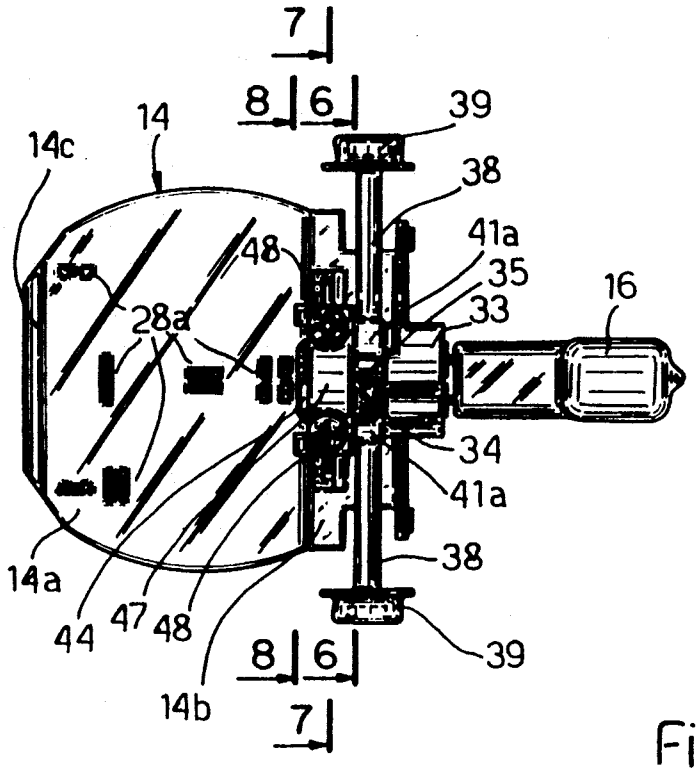
Figure 6:
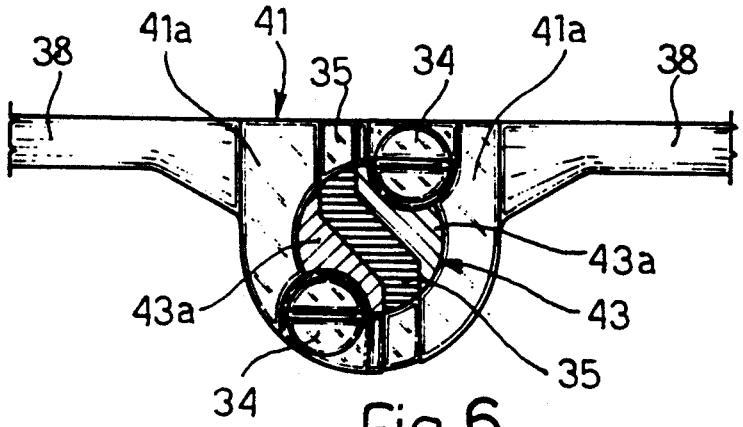
FIGS. 6, 7 and 8 show respective cross sections of the light along lines VI—VI, VII—VII and VIII—VIII in FIG. 5.
Figure 7:
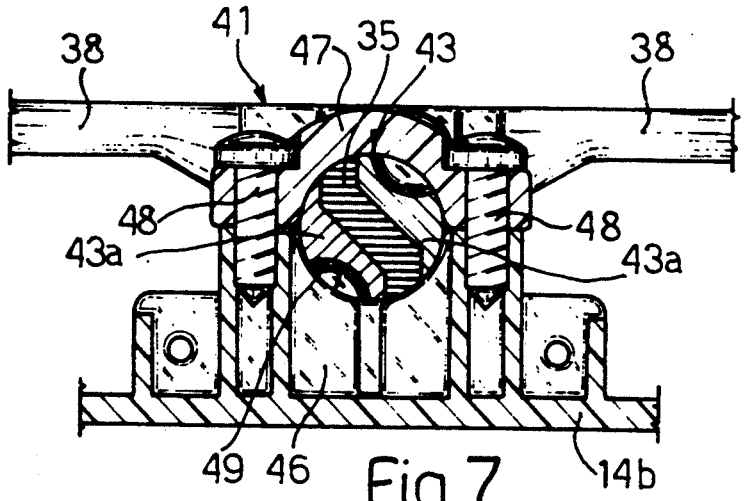
Figure 8:
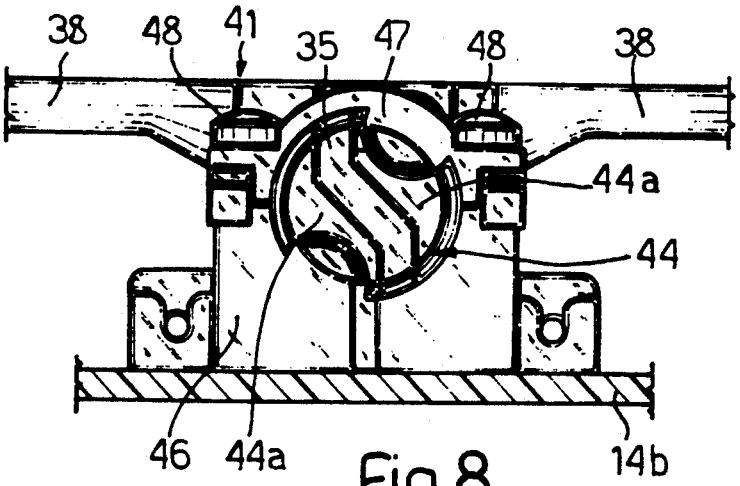

As shown in FIGS. 2 to 4, light 4 comprises: an oscillating support 12 connected mechanically and electrically to structure 3; a substantially prismatic-shaped housing 13*a* fitted to support 12 and consisting of a shaped body 13 partially closed by a cover 14; and a reflecting body 15 integral with housing 13*a* and enclosing, on three sides, a bulb 16 connectable to support 12.

As shown in the FIG. 2 side view, housing 13*a*, the external design of which is substantially the same as that of the aforementioned "Tizio" lamp, is shaped in the form of a parallelogram, one of the two oblique sides of which is continued in the form of an outwardly-projecting tab portion 17. Shaped body 13 defines a shell with a C-shaped cross section, open on the ideal surface corresponding to the oblique side of the parallelogram aligned with tab portion 17, and on the ideal base surface not adjacent to portion 17. Shaped body 13 is also divided ideally into two portions 18 and 19 by two transverse slots 20 (FIG. 5) extending in line with each other towards the center portion of the base side 21 of body 13 adjacent to tab portion 17. Said center portion is the sole connecting point between portions 18 and 19. Shaped body 13 also presents parallel intermediate partition walls 22 and 23 extending on either side of slots 20 and dividing the inside of housing 13*a* into two compartments separated by an intermediate gap and referred to, for the sake of simplicity, as front compartment 24 and rear compartment 25. Front compartment 24 houses reflector 15 and bulb 16; rear compartment 25 houses part of support 12; and the intermediate gap (corresponding to slots 20), which enables housing 13*a* to oscillate in relation to support 12, as shown later on, houses another portion of support 12. Front compartment 24, which is open on one side, presents means 26 for connection to reflector 15, which in turn presents means 26*a* for connection to cover 14 (FIG. 5), and is shaped substantially in the form of a dish similar to portion 18 of shaped body 13. Rear compartment 25, on the other hand, is fully closed by cover 14, which presents a portion 14*a* extending along the ideal oblique surface, and a portion 14*b* extending along part of the ideal base surface of body 13, so as to partially close the bottom of slots 20. Cover 14, which is fitted to body 13 by inserting end 14*c* into tab portion 17 (FIG. 4) and by means of screws 27 (FIG. 9) through cover 14 and wall 22, also defines internal connecting means 28*a* for a safety rod 28 projecting outwards of rear compartment 25, and a hinge seat 29 for support 12, as described in more detail later on. Finally, base side 21 of body 13 defines ventilation holes 30.

Support 12, which provides for enabling rotation of light 4 about transverse axis 31 (FIG. 5), and rotation of housing 13*a* (including reflector 15) about longitudinal axis 32 (FIG. 4), will now be described with reference to FIGS. 4 to 8. Support 12 consists of two halves made of electrically conductive material (e.g. aluminium) for defining conductive paths from the ends of rods 8 to a body 33 supporting bulb 16 and extending through wall 22 of body 13 and into front compartment 24, between wall 22 and reflector 15. Supporting body 33 is fitted to support 12 by means of two screws 34 (FIGS. 5 and 6) which also provide for ensuring electrical contact between the two halves of support 12 and the inside of supporting body 33. In view of the current carrying function of the two halves of support 12, these are separated and totally insulated by an insulating body 35.

As shown in FIGS. 3 to 8, support 12 comprises two aligned arms 38 defining rotation axis 31. Each arm 38 terminates at one end in a wider head 39 projecting from housing 13*a* and defining an axial recess (shown by the dotted line in FIG. 5) engaged by a pin (shown schematically by 4*c* in FIG. 3) integral with the ends of rods 8 for enabling rotation of support 12 about axis 31 in known manner.

The opposite ends of arms 38 are integral with respective wider portions 41*a* shaped so as to form, together, a shield type body 41 (FIGS. 6 and 9–11) housed in the gap defined by slots 20 between walls 22 and 23 on housing 13*a*. Body 41 is integral with a pivot pin 43 extending through an opening in wall 23 into rear compartment 25. Pivot pin 43 also consists of two halves 43*a* integral with respective wider portions 41*a* and extending perpendicularly in relation to arms 38. Pin 43, which presents a wider retaining end portion 44 also consisting of two halves 44*a*, is housed in rotary manner inside seat 29 on cover 14. In more detail, seat 29 comprises a projection 46 formed on the surface of cover portion 14*b* facing body 13; and a bracket 47 screwed to projection 46 by means of screws 48. Projection 46 and bracket 47 combine to define a cylindrical hole 49 having the same diameter as pin 43 and housing pin 43 so as to enable it to rotate in relation to its axis defining rotation axis 32.

During assembly, body 33 supporting the bulb is first fitted to wider portions 41*a* of support 12 by means of screws 34, so as to render the two halves of support 12 integral with each other (with insulating body 35 in between). Support 12 is then fitted to cover 14, by inserting it in the half hole defined by projection 46 and securing the bracket by means of screws 48. The cover is then fitted and screwed on to body 13, reflector 15 is fitted on, and light 4, so completed, is fitted on to the ends of rods 8.

Figure 9:
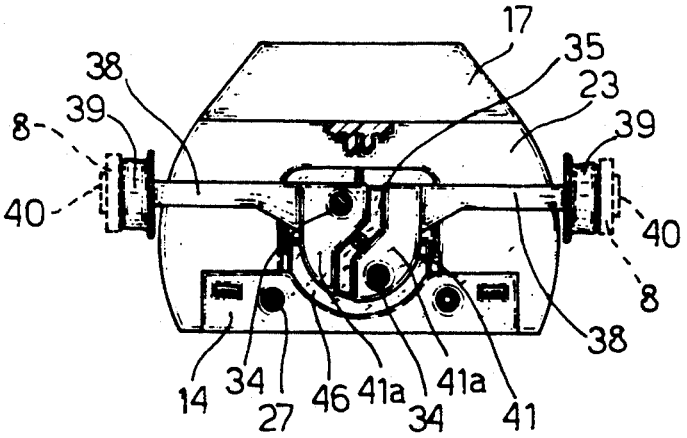
FIGS. 9, 10 and 11 show cross sections of the light along line IX—IX in FIG. 4 and in three different positions.
Figure 10:
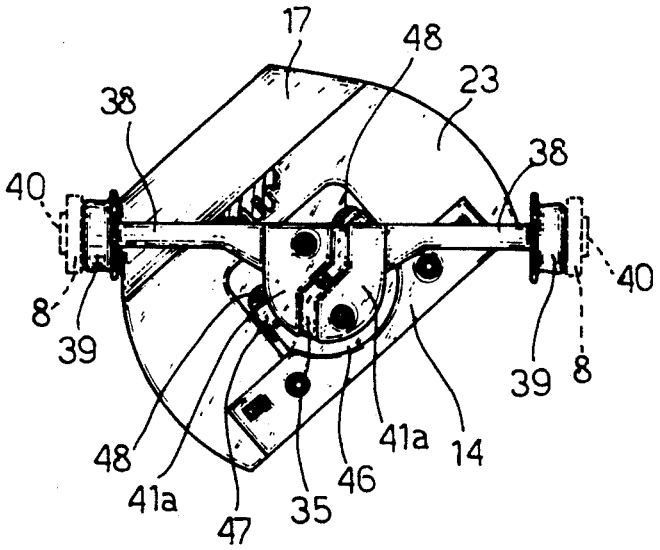
Figure 11:
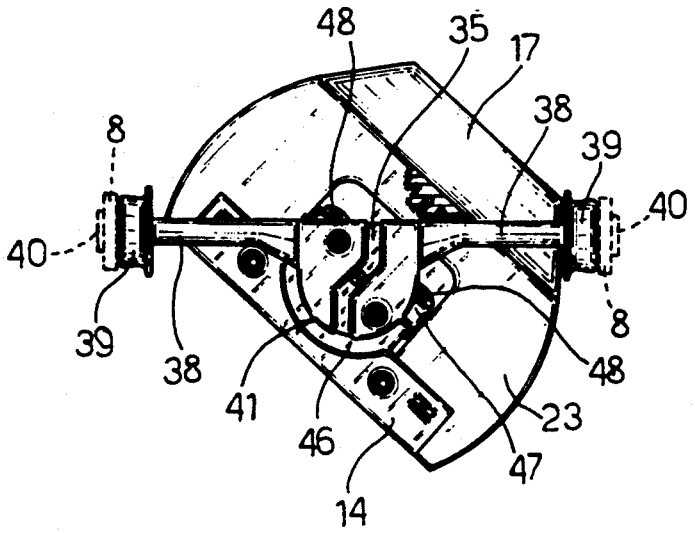

Support 12 thus enables light 4 to rotate, not only about transverse axis 31, as on the known lamp, but also about longitudinal axis 32, as shown in FIGS. 9 to 11. In particular, light 4, and consequently the light beam, is adjusted about longitudinal axis 32 by rotating housing 13*a* (together with reflector 15), while support 12 and bulb 16 remain fixed in relation to rods 8.

The advantages of the lamp according to the present invention will be clear from the foregoing description. In particular, oscillating support 12 provides for adjusting light 4 and so directing the beam of bulb 16 as required, while at the same time maintaining current supply via the structure with no wiring required. Support 12 in fact provides for ensuring electrical continuity between structure 3 and bulb supporting body 33, as well as for insulating the supply and return paths.

The hinging of support 12 to cover 14 as described above enables light 4 to be adjusted easily, while at the same time providing for sufficient friction for maintaining light 4 in the set position.

I claim:

1. A lamp (1), particularly a table lamp, comprising: a base (2); a load-bearing structure (3) fitted to said base (2) and defining a path along which power is conducted; and a light (4) supported on said structure (3), said light (4) including a housing (13*a*) and a support (12) located between said structure (3) and said housing (13*a*) and designed to enable rotation of said housing (13*a*) about a first axis (31), and to ensure electrical continuity between said structure (3) and a bulb (16) fitted to said support (12); characterised by the fact that said support (12) comprises means (43) enabling rotation of said housing (13*a*) about a second axis (32) perpendicular to the first (31) and that said support (12) comprises two aligned arms (38) each defining, at a first end, means (39) for hinging said housing (13*a*) to said structure (3); and a pin (43) fitted to a second end of said arms (38), extending perpendicularly to said arms (38), and housed in rotary manner in said housing (13*a*); said arms (38) defining said first axis of rotation (31), and said pin (43) defining said second axis of rotation.

2. A lamp as claimed in claim 1, characterised by the fact that said housing (13*a*) presents an elongated prismatic shape extending parallel to said second axis of rotation (32); said arms (38) extending crosswise in relation to said elongated prismatic shape.

3. A lamp as claimed in claim 1, characterised by the fact that said pin (43) comprises two portions (43*a*) insulated electrically in relation to each other and formed in one piece with a respective arm (38).

4. A lamp as claimed in claim 1, characterised by the fact that said housing (13*a*) presents an internal projection (46) having a through hole (49) housing and having the same diameter as said pin (43).

5. A lamp as claimed in claim 1, characterised by the fact that each of said arms (38) presents, at said second end, a flat wider portion (41*a*) from which extends a respective portion (43*a*) of said pin (43); each said wider portion (41*a*) being fitted and electrically connected by means of screws (34) to a body (33) supporting said bulb (16).

6. A lamp as claimed in claim 1, characterised by the fact that said housing (13*a*) presents two opposed, aligned, transverse slots (20) housing said arms (38) for adjusting said housing (13*a*); said first end (39) of said arms (38) projecting outwards of said slots (20).

7. A lamp as claimed in claim 6, characterised by the fact that said housing (13*a*) presents two intermediate transverse walls (22, 23) extending on either side of said slots (20) and dividing said housing (13*a*) into a first and second compartment (25, 24) mutually separated by said slots (20); said first compartment (25) being closed on all sides and housing said pin (43) in rotary manner; and said second compartment (24) being open on one side and housing a reflector (15) and said body (33) supporting said bulb (16); said supporting body (33) being fitted through one (22) of said walls (22, 23) and to said support (12).

8. A lamp as claimed in claim 7, characterised by the fact that said housing (13*a*) comprises a shaped body (13) in the form of a parallelogram, when viewed laterally, with its base side and one oblique side open; and a cover (14) extending along said oblique side and closing said first compartment (25); said cover (14) having a projection (46) cooperating with a bracket (47) fitted to said projection (46) by means of screws (48); said projection (46) and said bracket (47) defining for said pin (43) a cylindrical seat (29) parallel to the open base side of said body (13); said pin (43) defining a wider retaining end portion (44) projecting from said cylindrical seat (29) on the opposite side in relation to said flat wider portion (41*a*) of said arms (38).

* * * * *